US007373763B2

(12) United States Patent
Voegele, Jr. et al.

(10) Patent No.: US 7,373,763 B2
(45) Date of Patent: May 20, 2008

(54) GLASS BLOCK ASSEMBLY

(75) Inventors: William P. Voegele, Jr., Fox Chapel Borough, Allegheny County, PA (US); Alan D. Lohr, McCandless Township, Allegheny County, PA (US); Raymond A. McNally, Blawnox, PA (US); Michael R. Quinlan, Cranford, NJ (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 786 days.

(21) Appl. No.: 10/705,702

(22) Filed: Nov. 10, 2003

(65) Prior Publication Data

US 2004/0177577 A1 Sep. 16, 2004

Related U.S. Application Data

(60) Provisional application No. 60/454,472, filed on Mar. 13, 2003.

(51) Int. Cl.
*E04C 1/42* (2006.01)

(52) U.S. Cl. ..... 52/308; 52/223.7; 52/232; 52/656.5

(58) Field of Classification Search ..... 52/306, 52/307, 308, 456, 447, 664, 601, 667, 223.7, 52/475.1, 656.5
See application file for complete search history.

(56) References Cited

U.S. PATENT DOCUMENTS 1,093,587 A * 4/1914 McClure ..... 52/456
1,101,745 A * 6/1914 Jones ..... 52/456
2,052,229 A 8/1936 Hyde
2,199,244 A * 4/1940 Mulford ..... 52/307
2,996,845 A * 8/1961 Cipriani et al. ..... 52/475.1
3,234,699 A 2/1966 Smith
3,284,976 A * 11/1966 Kadish ..... 52/455
3,844,087 A 10/1974 Schultz et al.
4,058,943 A 11/1977 Sturgill
4,114,337 A 9/1978 Neuhardt
4,251,964 A 2/1981 Francis
4,455,798 A 6/1984 Tsakiris
4,576,502 A * 3/1986 Bancroft ..... 403/231
4,610,901 A 9/1986 Linscott
4,638,613 A 1/1987 Tonsmann
4,702,055 A * 10/1987 Ralph ..... 52/456
4,774,793 A 10/1988 Mayer
4,860,517 A * 8/1989 Kipross ..... 52/656.2
4,965,975 A 10/1990 Schwarz (Continued)

FOREIGN PATENT DOCUMENTS

JP 62-244935 * 10/1987

(Continued)

*Primary Examiner*—Robert Canfield
(74) *Attorney, Agent, or Firm*—McKay & Associates, P.C.

(57) ABSTRACT

An assembly of glass blocks held in a structural frame comprises a plurality of glass blocks, a rectangular structural perimeter frame, a plurality of primary muntins, each said primary muntin comprising an elongate web, the primary muntins extending entirely across the structural perimeter frame, a plurality of extruded secondary muntins, and a plurality of structural rods inserted through the secondary muntins and extending entirely across the structural perimeter frame, such that the primary and secondary muntins form a matrix within the structural perimeter frame with openings for receiving the plurality of glass blocks.

21 Claims, 12 Drawing Sheets

U.S. PATENT DOCUMENTS

| | | | | |
|---|---|---|---|---|
| 4,986,048 | A | 1/1991 | McMarlin | |
| 4,999,964 | A | 3/1991 | Taylor | |
| 5,003,744 | A | 4/1991 | Taylor | |
| 5,010,704 | A | 4/1991 | Thompson | |
| 5,014,471 | A * | 5/1991 | Ballstadt | 52/98 |
| 5,031,372 | A | 7/1991 | McCluer | |
| 5,042,210 | A | 8/1991 | Taylor | |
| D331,469 | S | 12/1992 | McMarlin | |
| 5,218,806 | A | 6/1993 | Taylor | |
| 5,259,161 | A | 11/1993 | Carter | |
| 5,356,675 | A | 10/1994 | Unger et al. | |
| 5,430,985 | A | 7/1995 | Coleman | |
| 5,448,864 | A | 9/1995 | Rosamond | |
| 5,485,702 | A | 1/1996 | Sholton | |
| 5,704,177 | A | 1/1998 | Wirkus et al. | |
| 5,715,636 | A | 2/1998 | Taylor | |
| 5,740,646 | A | 4/1998 | Wirkus et al. | |
| 5,806,263 | A | 9/1998 | Coleman | |
| 5,992,111 | A * | 11/1999 | Waterhouse | 52/308 |
| 6,922,961 | B2 | 8/2005 | Wright | |
| 2004/0177577 | A1 | 9/2004 | Voegele, Jr. et al. | |
| 2005/0102931 | A1 * | 5/2005 | Ringness | 52/204.1 |

FOREIGN PATENT DOCUMENTS

| | | | |
|---|---|---|---|
| JP | 5-230899 | * | 8/1993 |

* cited by examiner

GLASS BLOCK ASSEMBLY

CROSS-REFERENCE TO RELATED APPLICATIONS

This application claims the benefit of U.S. Provisional Patent Application Serial No. 60/454,472, filed Mar. 13, 2003, entitled "Structural Wall, Skylight and Flooring System For Use With Glass Blocks".

BACKGROUND OF THE INVENTION

1. Field of the Invention

The present invention is directed to glass block walls, skylights, and floors, and, more particularly, to an assembly of glass blocks held in a structural frame.

2. Description of Related Art

For many years, glass blocks have been used as building materials for walls, skylights, and floors.

There have been problems with existing systems for glass blocks. For one, the glass blocks are typically set in rigid or semi-rigid mortar which tends to crack and leak with age. When mortar is mixed at the job site, there is little control over the amount of water added and, therefore, the strength and weatherability of the mortar. Mortared block walls, even when reinforced, have limited structural strength. Alignment of blocks laid at the job site is often inconsistent. Finally, field weather conditions are often unpredictable, affecting the quality of mortared glass block walls built on site.

Glass block assemblies involving a framework for holding the glass blocks have been proposed, for example, in U.S. Pat. Nos. 4,058,943; 5,031,372; 5,042,210; and 5,218,806.

SUMMARY OF THE INVENTION

It is an advantage of the present invention to provide an improved glass block assembly which offers great structural strength and security independent of the blocks and sealants.

It is a further advantage to provide a glass block assembly in a frame that enables accurate alignment.

It is a still further advantage to provide a glass block assembly which seals the intersections between the blocks against water and air infiltration and a construction that directs water leakage, if any, to the exterior.

It is yet another advantage to provide a glass block assembly which allows replacement of blocks in a manner in which the new blocks and joints will have the same appearance as the original blocks and joints.

Briefly, according to this invention, there is provided an assembly of glass blocks held in a structural perimeter frame comprising a plurality of glass blocks each having two rectangular display faces and four edge faces, a rectangular structural perimeter frame having four sides, a plurality of primary muntins, and, when needed, a plurality of secondary muntins. Preferably, the muntins and structural perimeter frame are aluminum extrusions or steel fabrications. Each of the primary muntins comprises an elongate web with elongate stand-offs extending outward from the faces of the web and at least one elongate hollow boss integral with the web. The primary muntins extend entirely across the structural perimeter frame either vertically or horizontally. Each secondary muntin comprises an elongate web with stand-offs extending from the faces of the web and at least one hollow boss integral with the web. The secondary muntins extend for a length that is just somewhat longer than a length of an edge face or a display face of the glass blocks. The widths of the primary and secondary muntins may be substantially the same or may differ. While primary muntins must always be used, the use of secondary muntins is optional.

A plurality of structural rods (e.g., steel rods) is inserted through the hollow bosses of the secondary muntins and extends entirely across the structural perimeter frame. The rods also pass through holes in the primary muntins. Thus, the primary and secondary muntins form a matrix within the structural perimeter frame with openings for receiving the plurality of glass blocks.

The muntin matrix may be secured to the structural perimeter frame by nuts on threaded ends of the rods inserted through the hollow bosses of the secondary muntins and/or by rods inserted through the hollow bosses of the primary muntins or, alternatively, by other fasteners, such as screws, engaging the hollow bosses of the primary muntins.

The primary and secondary muntins are different in several ways. One difference is that a hollow boss in the primary muntin is not located at the same position across the width of the muntin as a hollow boss in the secondary muntin is located, thus enabling the rods to cross through the assembly without interfering with each other. The width of the muntins is substantially less than, equal to, or greater than the width of the edge faces of the glass blocks. A gasket, such as a rubber or plastic boot, flexible foam tape, or other suitable elastomeric material, is located on each edge face of the glass blocks (i.e., completely or partially surrounding a perimeter of each block) to form a compressible elastomeric spacer. The elastomeric spacers on the glass blocks contact the muntins when the glass blocks are engagingly inserted in the matrix. Alternatively, the elastomeric spacers may be applied to the muntins, in which case the glass blocks engage the elastomeric spacers when the glass blocks are engagingly inserted in the matrix.

The glass blocks are sealed in the muntin matrix with caulking material between the edge faces. The elastomeric spacers also serve as a proper breathable backer for the caulking, which will seal the joints between the glass blocks. One type of glass blocks typically has central recesses on the edge faces generally parallel to the exposed display faces. Preferably, the caulking enters the recesses. According to a preferred embodiment, the primary and secondary muntin webs have at least one edge having a bead thereon, and the assembly further comprises a plurality of elastomeric joint covers that snap over the beads. Preferably, the elastomeric joint covers have a graffiti-resistant coating.

According to one embodiment, at least one side of the structural perimeter frame comprises two channels: one channel with extending substantially parallel webs slides within the extending parallel webs of the other channel with a seal therebetween permitting slight relative movement between the channels. Each channel has a center web with a non-metallic thermal break therein.

Briefly, according to this invention, there also is provided an assembly of glass blocks held in a structural perimeter frame for non-vertical use similar to the assembly already described. In this assembly, each primary muntin is comprised of an elongate web with elongate stand-offs extending outward from faces of the web and at least one elongate hollow boss integral with the web. Stop flanges, perpendicular to the web, are integral with the primary muntins and arranged with gaskets for abutting edges of exposed glass block display faces.

Each secondary muntin is comprised of a web with stand-offs extending from the faces of the web and at least one hollow boss integral with the web. Stop flanges, perpendicular to the web, are integral with each secondary muntin and arranged with gaskets for abutting the edges of exposed glass block display faces.

A plurality of structural rods inserted through the hollow bosses of the secondary muntins and passing through holes in the primary muntins extends from side to side (i.e., across) the structural perimeter frame, such that the primary and secondary muntins form a matrix within the structural perimeter frame with openings for receiving the plurality of glass blocks. Preferably, a plurality of structural rods is also inserted through the hollow bosses of the primary muntins and extends from top-to-bottom (i.e., perpendicular to the rods inserted through the secondary muntins) of the structural perimeter frame.

Preferably, the primary and secondary muntins are configured such that the stop flanges of the secondary muntins extend over the stop flanges of the primary muntins. Gaskets abutting the stop flanges provide surfaces for receiving and supporting the edges of one display face of each glass block. The gaskets on the stop flanges of the primary muntins are thicker than the gaskets on the stop flanges of the secondary muntins, so that the glass blocks are equally supported by both primary and secondary muntins' gaskets.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

Figure 1:
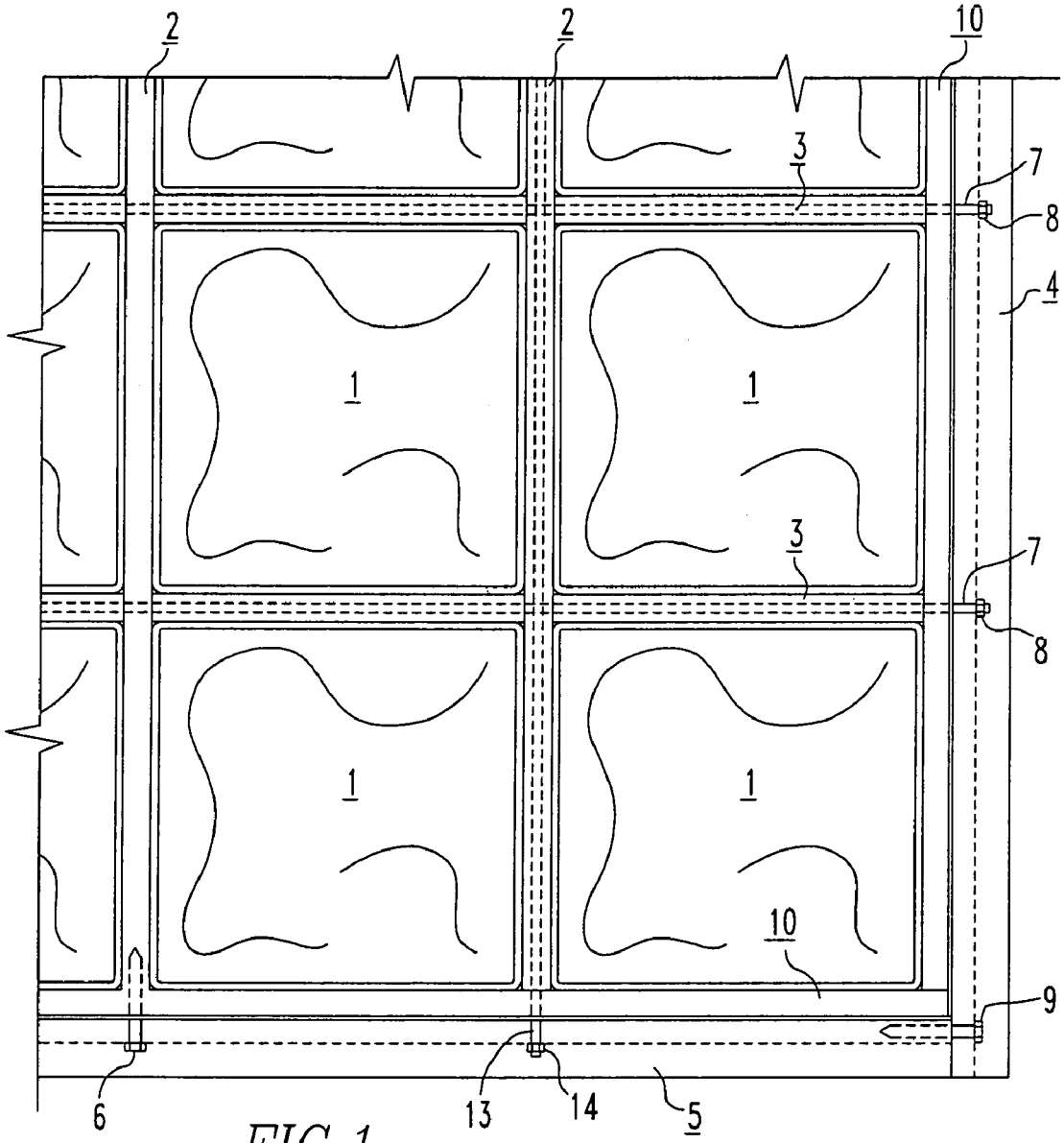
FIG. 1 is an elevation view of a portion of glass block assembly according to this invention.

FIG. 1 shows a glass block assembly having an aluminum or steel structural perimeter frame supporting an extruded aluminum muntin grid or matrix for positioning glass blocks 1. As shown, the grid or matrix is comprised of horizontal muntins 3 and vertical muntins 2. The structural perimeter frame is comprised of vertical and horizontal channel members 4, 5 held together by screw fasteners 9. The vertical (i.e., main or continuous) muntins in this embodiment are referred to as primary muntins or primary grid members as they extend uninterrupted from one side of the structural perimeter frame to the other. The primary muntins are secured to the structural perimeter frame by fasteners such as screws 6. Alternatively, they may be secured by threaded rods 13 inserted through the primary grid members and secured by nuts 14 at each end thereof. The rods extend entirely across the assembly and through the structural perimeter frame. In this embodiment, the horizontal (i.e., non-continuous) muntins 3 are referred to as secondary muntins or secondary grid members as they comprise many short sections that fit abuttingly between each primary muntin 2. The secondary muntins are secured in place by threaded rods 7 passing through each section of the secondary muntins (in hollow bosses to be described) and through holes in the primary muntins. The rods are secured by nuts 8 on each end thereof. The rods extend entirely across the assembly and through the structural perimeter frame so that the threaded ends are exposed for receipt of the nuts.

Figure 2A:
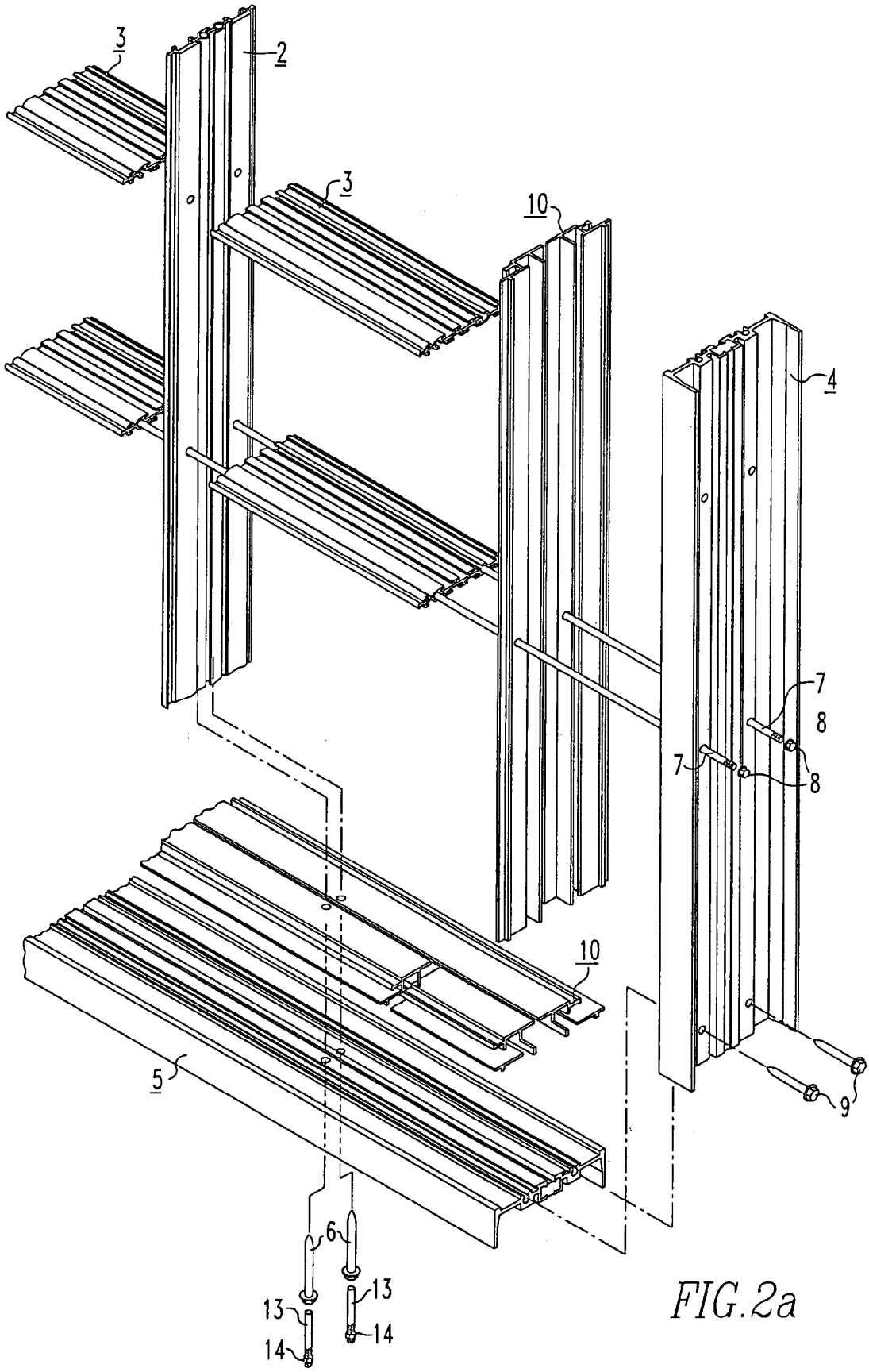
FIG. 2*a* is an exploded isometric view of a muntin grid and structural perimeter frame members for the glass block assembly of FIG. 1.
Figure 2B:
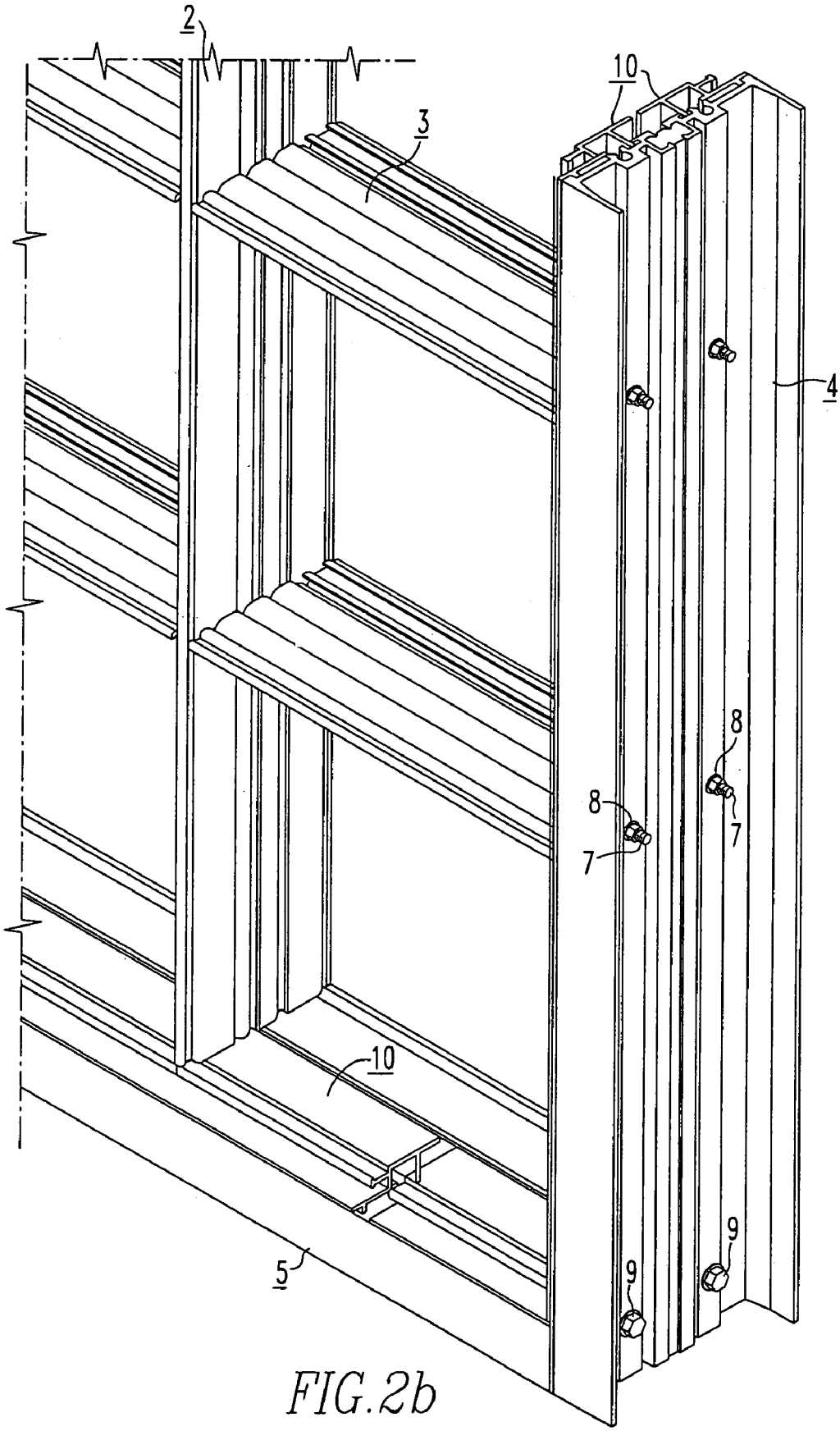
FIG. 2*b* is an assembled isometric view of the muntin grid and structural perimeter frame.

In the exploded isometric view of FIG. 2*a* and the assembled isometric view of FIG. 2*b*, the manner in which the primary and secondary muntins are held in the structural perimeter frame by threaded rods and screw fasteners is readily apparent. As can be seen, the structural perimeter frame comprises channel members 4, 5 and extruded edge spacers 10. The details of the configuration of the primary and secondary muntins, channel members, and edge spacers will be explained.

Figure 2C:
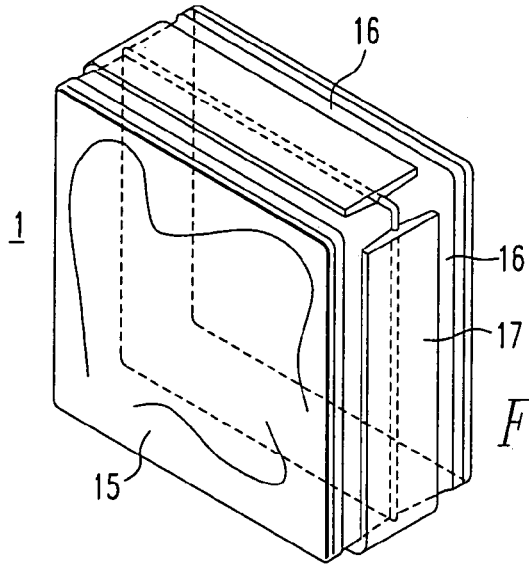
FIG. 2*c* is an isometric view of a glass block with elastomeric spacers shown on the visible edge faces.

FIG. 2*c* is an isometric view of a glass block. The glass block has two display faces 15 and four edge faces 16. The edge faces may have central troughs. FIG. 2*c* also shows a resilient elastomeric spacer 17 along the edge faces 16 of the block in preparation for sliding the block into the matrix.

Figure 2E:
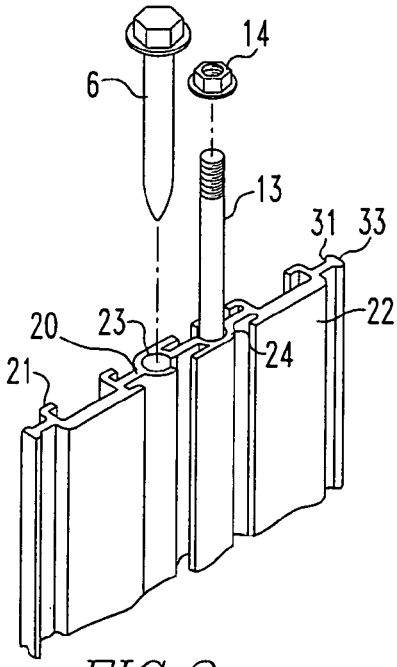
FIG. 2*e* is a partial view of a primary muntin illustrating the use of a screw or a threaded rod to secure the muntin to the structural perimeter frame.
Figure 2F:
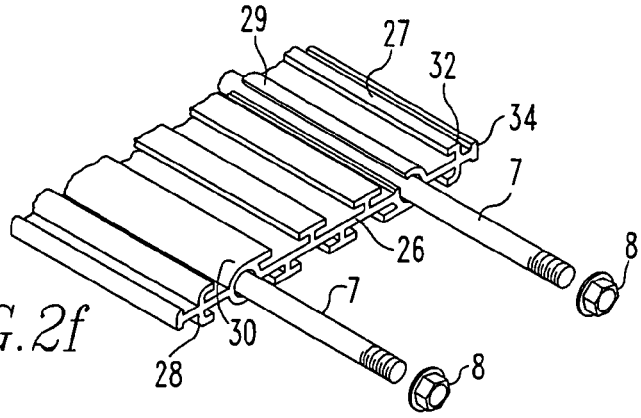
FIG. 2*f* is a partial view of a secondary muntin illustrating the use of threaded rods to secure the muntin to the structural perimeter frame.
Figure 2D:
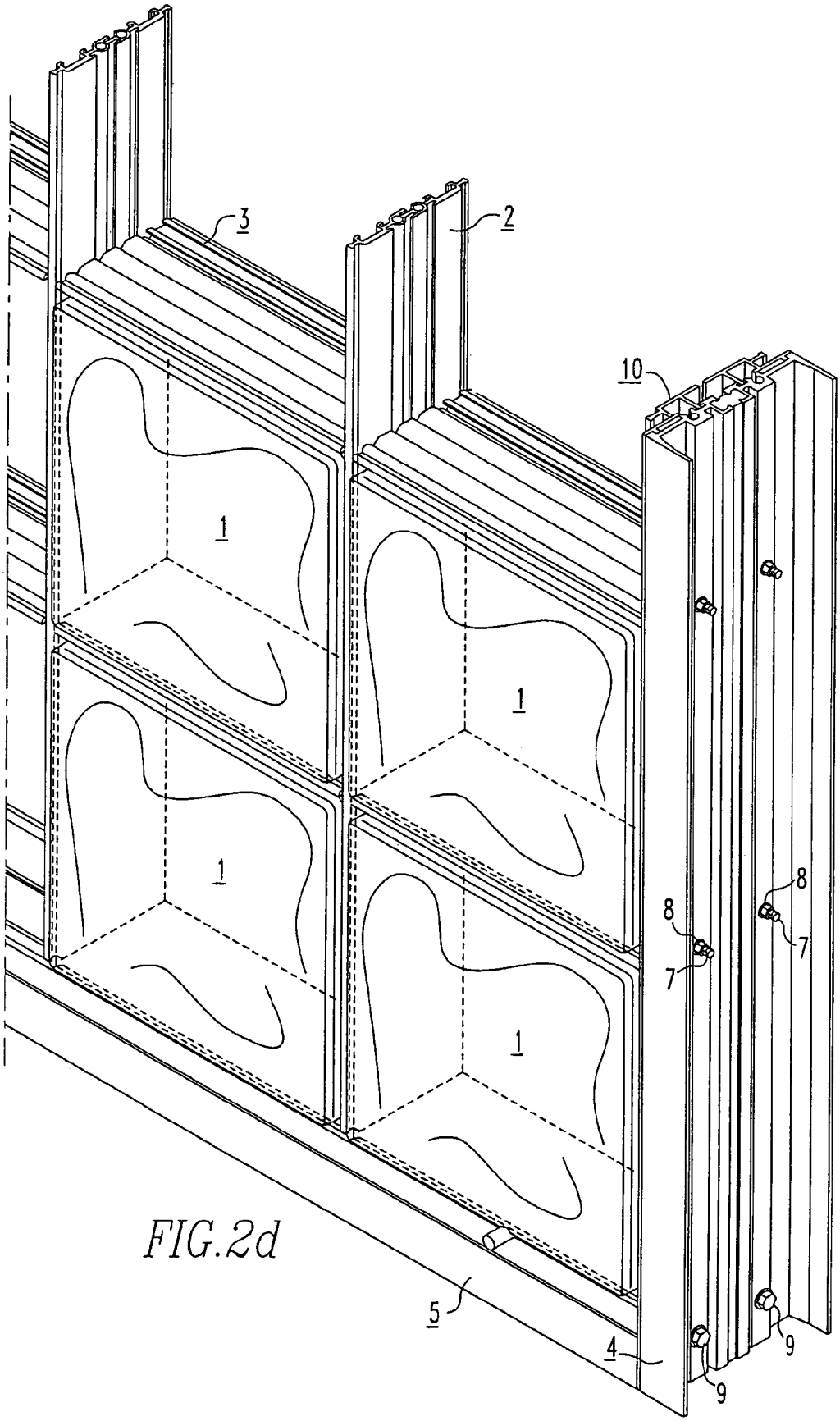
FIG. 2*d* is an isometric view of a portion of the glass block assembly according to this invention.

The cross sections of the primary and secondary muntins are easily observed in FIGS. 2*e* and 2*f*. The muntins being extruded structures, all surfaces are parallel to the direction of extrusion and there are no totally enclosed volumes in the muntins. The primary muntins, as shown in FIG. 2*e*, have a web 20 that has offsets (raised flat portions or stand-offs) 21 and 22. The surfaces of the offset portions lie within two parallel planes that are spaced apart from each other. The distance between these planes partially determines the spacing between glass blocks in the glass block assembly. The primary muntin has two hollow bosses 23, 24. The hollow bosses have axial gaps in their cylindrical walls opening to opposite sides of the muntin. The outer diameters of the hollow bosses fall within the spaced parallel planes referred to above. The two hollow bosses 23, 24 are adjacent to each other and near the center of the width of the extruded primary muntin.

The secondary muntins have a web 26 with offsets (raised flat portions or stand-offs) 27, 28 and spaced hollow bosses 29, 30. The surfaces of the offset portions 27, 28 lie within two parallel planes. The hollow bosses 29, 30 are positioned within the two planes.

Extending laterally from the primary and secondary muntins are webs 31, 32 that terminate in beads 33, 34, respectively. Snap-on joint covers 37 may be placed over the beads.

The width of the primary and secondary muntins may be the same or may differ.

The function of the offsets or raised flat portions 21, 22, 27, 28 on the muntins is to allow the glass block 1 when wrapped with the elastomeric spacer 17 to slide into position without allowing the elastomeric spacer to fall into a cavity and thus impede the smooth insertion of the block and elastomeric spacer assembly.

FIG. 2*e* shows how the primary muntin may be fastened in position with screws 6 of sufficient diameter to thread into the inside of the hollow bosses or by steel rods 13 with diameters small enough to pass through the hollow bosses. For example, the inside diameter of the hollow boss 24 may be just large enough (for example, 0.211 inch diameter) to have a sliding fit with a steel rod 3/16 inch in diameter. In that case, a ¼ inch diameter screw 6 will, alternatively, thread into the hollow boss 23. Similarly, FIG. 2*f* shows how the secondary muntin is secured. The locations of the hollow bosses of the secondary muntins are different, however. The hollow bosses 29, 30 are spaced farther apart and closer to the edges of the muntin. In this way, two steel rods can pass through a primary muntin and two steel rods can pass through an aligned secondary muntin without interfering. The primary muntins are provided with holes for the steel rods, which are held in the hollow bosses of the secondary muntins, to pass through.

Figure 3A:
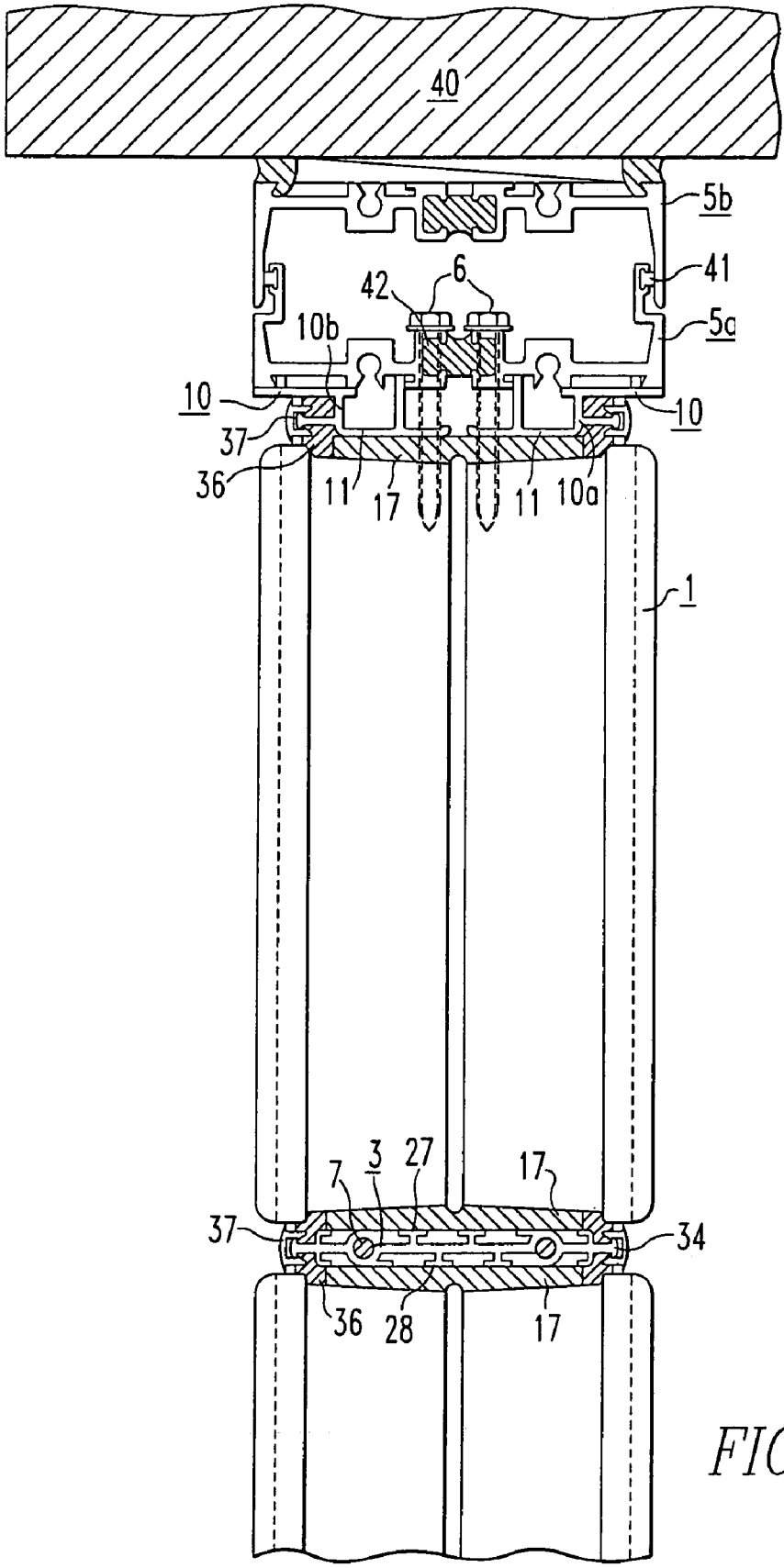
FIG. 3*a* is a broken away view illustrating the details of the joint between two glass blocks provided by a secondary muntin, the details of a flexible structural perimeter frame, and the details of a two-part extruded edge spacer and illustrating how the muntin matrix may be secured to the structural perimeter frame via screws threaded into the bosses of the primary muntins.
Figure 3B:
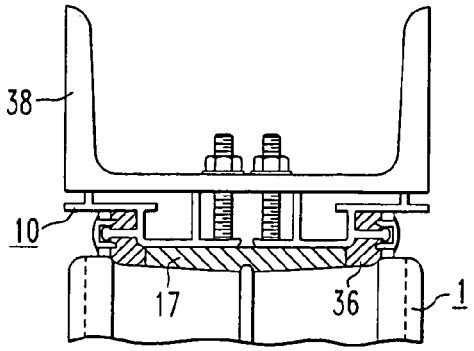
FIG. 3*b* is a broken away view illustrating the details of a structural perimeter frame in the form of a channel and the two-part extruded edge spacer.
Figure 3C:
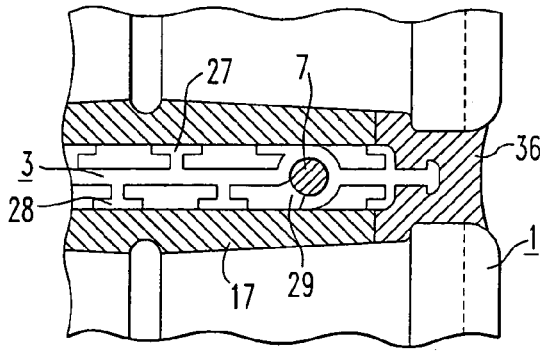
FIG. 3*c* is a broken away view of the details of a joint between two glass blocks according to an alternate embodiment of this invention.
Figure 3D:
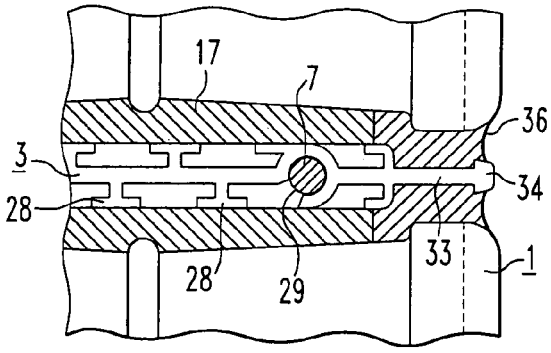
FIG. 3*d* is a broken away view of the details of a joint between two glass blocks according to another alternate embodiment of this invention.
Figure 3E:
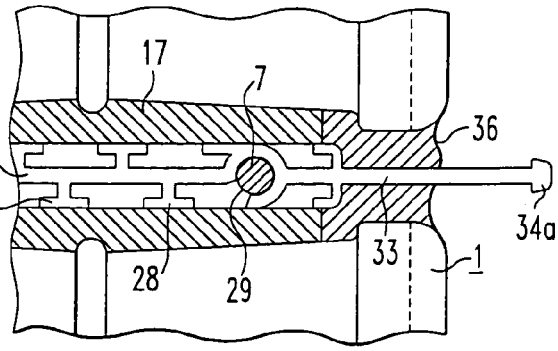
FIG. 3*e* is a broken away view of the details of a joint between two glass blocks according to another alternate embodiment of this invention.

Referring to FIGS. 3*a*, 3*c*, and 3*d*, there are shown sections through the joints between glass blocks, which joints are supported by secondary muntins 3. The elastomeric spacer 17 on the edge face of one glass block rests on the flat portions 27 on one side of the muntin 3 and the elastomeric spacer 17 on the edge face of the adjacent glass block rests on the flat portions 28 on the other side of the muntin. Preferably, the elastomeric spacer is made of an intumescent material to act as a fire barrier. The glass blocks are secured in place by a sealant 36 that is backed up by the elastomeric spacer 17. In the examples shown in FIGS. 3*c* and 3*d*, the sealant 36 covers the extruded muntin or mostly covers the muntin. The caulking material is typically a silicone resin or other elastomeric sealant. In the example of FIG. 3*a*, the bead 34 on the edge of the muntin is exposed sufficiently for the snap-on joint cover 37 to be affixed. Alternatively, as shown in FIGS. 3*d* and 3*e*, the bead 34 may be exposed or an extension 34*a* may be exposed. This alternative exposure may occur on primary and/or secondary muntins.

Referring to FIG. 3*a*, there is shown an extruded aluminum edge spacer 10 which is placed within the structural perimeter frame and is adjacent to the glass block 1 at the perimeter of the glass block assembly. The edge spacer 10 is captured against a channel 5*a* when screws 6 are driven into the primary muntin (not shown). The edge spacer comprises a web that, as shown, has two spaced halves 10*a* and 10*b*. The web has flat portions 11 and flanges extending from the sides with a beaded edge (similar to the bead 33, 34 of muntins 2, 3). The flat portions 11 have the purpose of abutting the elastomeric spacer 17 on the perimeter face of a glass block. The edge spacer has bores, one on each side, for receiving threaded rods (not shown) or screws 6. In FIG. 3*a*, screws extend through the bores in edge spacer 10 and enter the hollow bosses of a vertical primary muntin (not shown). In FIG. 3*b*, threaded rods extend through channel 38, bores in the edge spacer 10, and continue through a primary muntin (not shown).

Figure 4:
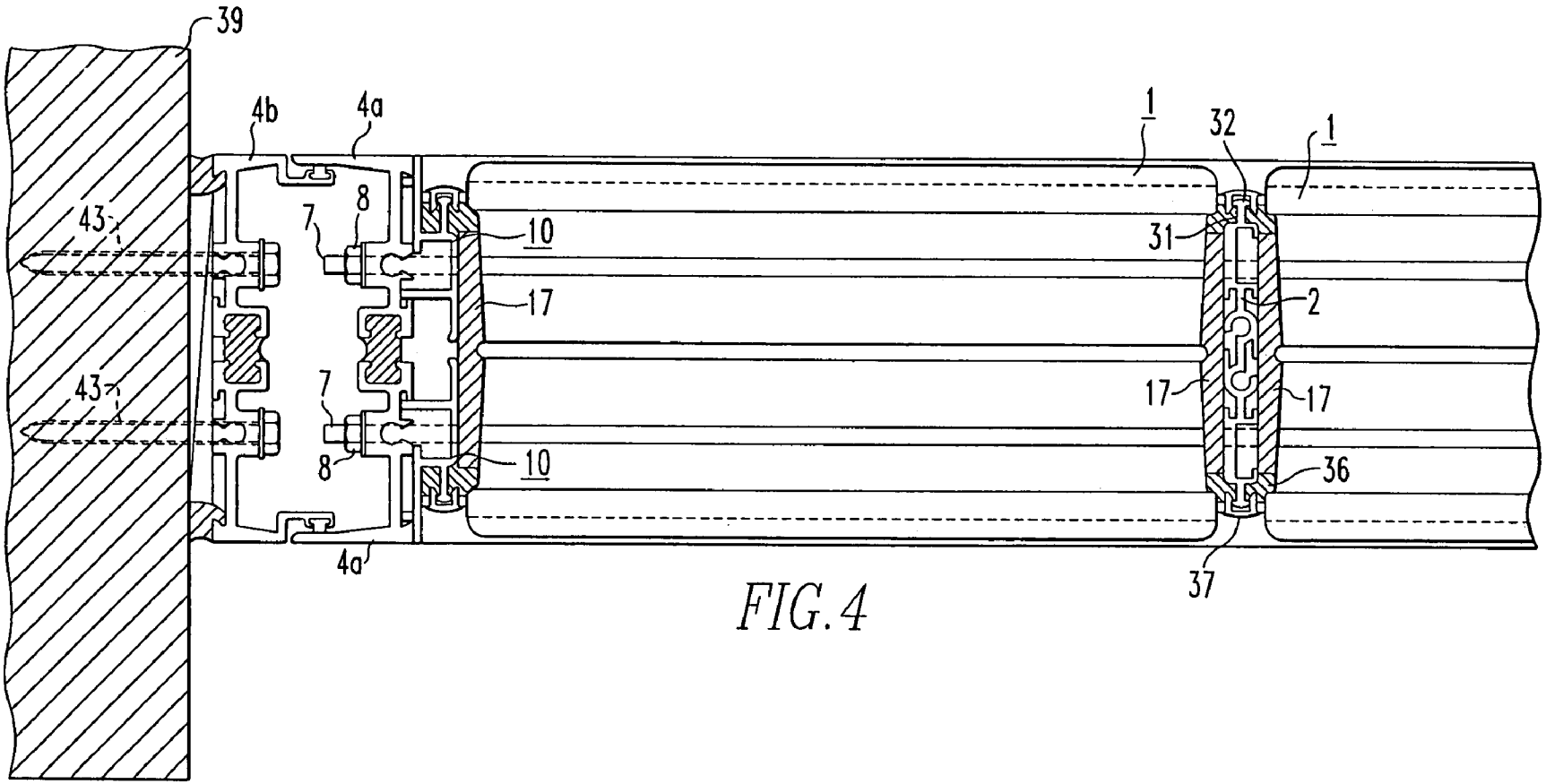
FIG. 4 is similar to FIG. 3*a* further illustrating how the flexible structural perimeter frame can be secured to an adjacent wall, but FIG. 4 illustrates the joint between glass blocks provided by a primary muntin and an attachment of the muntin matrix to the structural perimeter frame via rods with nuts.

Referring again to FIG. 3*a*, an edge spacer 10 is secured to an adjustable frame which comprises two two-part facing perimeter channels 5*a*, 5*b* with substantially parallel side flanges and with channel 5*b* abutting substrate 40. The side flanges of channel 5*a* slide within the side flanges of channel 5*b*. A gasket 41 is positioned between the side flanges that slide relative to each other. The two parts of each of the channels 5*a*, 5*b* are separated by a thermal break which may comprise a rigid plastic filler 42, such as urethane, that is captured by each part of the channels. The channels are preferably extruded aluminum and the plastic fillers are rigid materials, such as urethane. Channel 5*a* has bores, one in each part, for receiving threaded rods or screws. In FIG. 3*a*, screws extend through the bores in channel 5*a* and enter the hollow bosses of a perpendicular perimeter channel (not shown). FIG. 4 (at the left side) shows an edge spacer 10 and an adjustable frame comprising two facing perimeter channels 4*a*, 4*b* similar to that shown in FIG. 3*a*. Screws 43 through one channel 4*b* fasten it to a wall or other substrate 39, and threaded rods 7 and nuts 8 in the other channel fix a secondary muntin in place.

Figure 5:
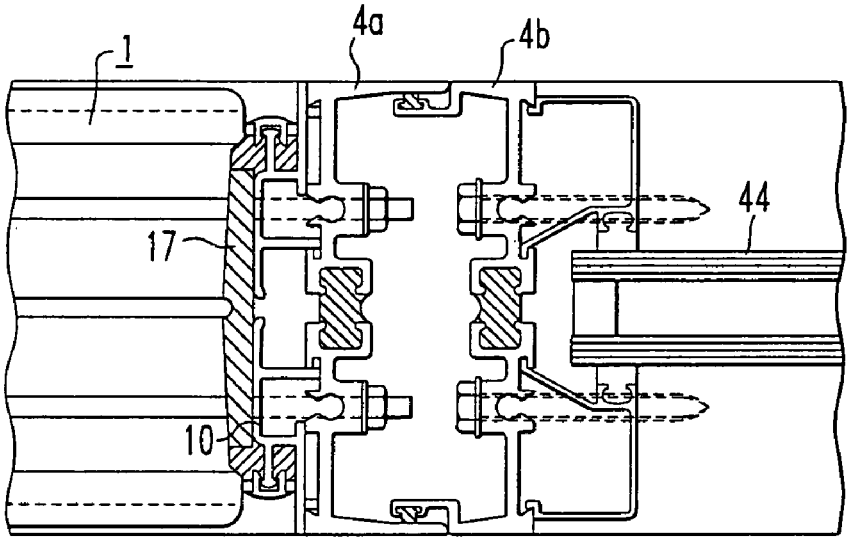
FIG. 5 is a broken away view that illustrates a transition between a glass block assembly and an insulated vision glass window.

FIG. 5 illustrates an intersection between two perimeter channels 4*a*, 4*b* in an adjustable gasketed manner. It also illustrates a transition from the glass block system herein to a panel with similar perimeter structural framing and which uses vision glass 44 by a vision glass fixing method well known in the industry.

Figure 6:
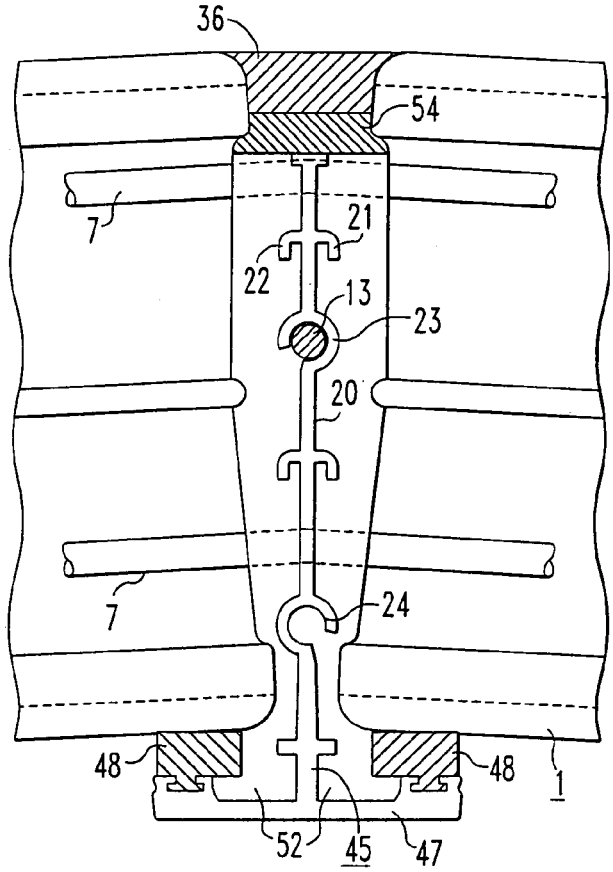
FIG. 6 is a broken away view through a primary muntin having perpendicular stop flanges for supporting a non-vertical glass block assembly.
Figure 7:
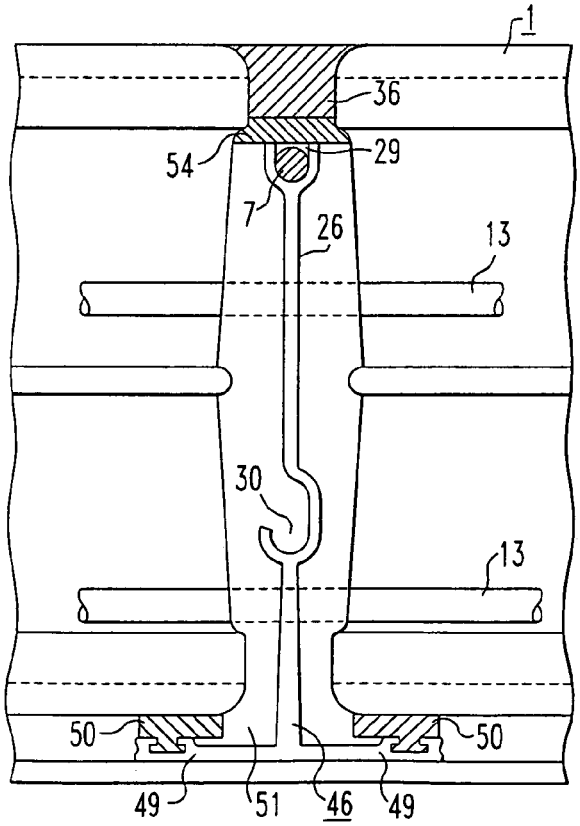
FIG. 7 is a broken away view through a secondary muntin having perpendicular stop flanges for supporting a non-vertical glass block assembly.
Figure 8:
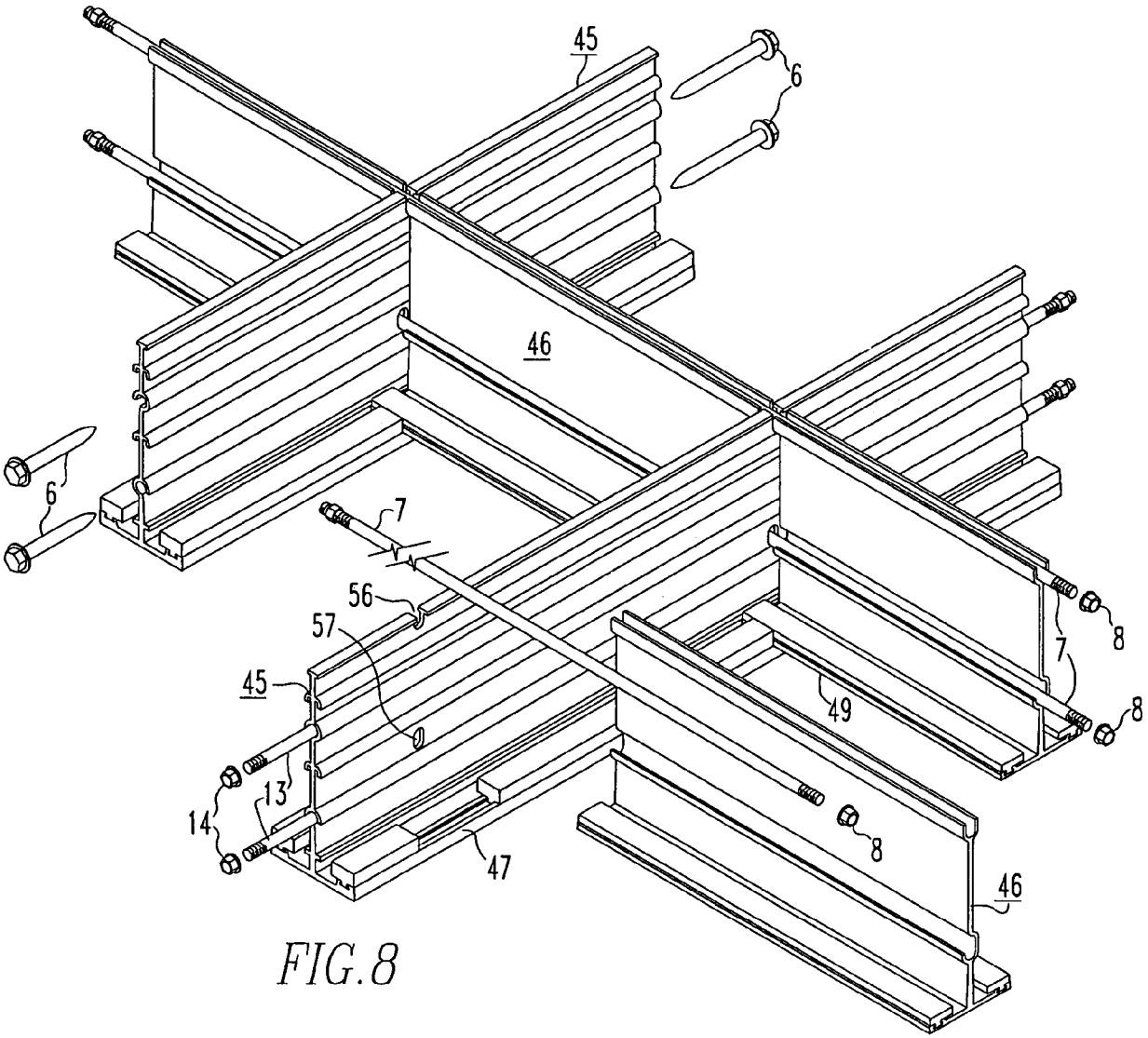
FIG. 8 is a partially exploded isometric view of the muntin grid for supporting a non-vertical glass block assembly according to this invention.

FIGS. 6, 7, and 8 relate to an embodiment of this invention for horizontal placement of the glass blocks as in skylights or load-bearing floors. The extruded primary muntin 45 shown in section in FIG. 6 has not only the web 20, offsets 21, 22 and hollow bosses 23, 24 as already described with reference to vertically oriented embodiments, but has a perpendicular flange 47 at the base and extending to an opposite side thereof. Positioned on the flange on each side is a gasket 48 upon which edges of the display face of the glass block 1 rest.

FIG. 7 shows a section through the secondary muntin 46 which also has a perpendicular flange 49 with a gasket 50 positioned thereon for supporting edges of the display faces of the glass blocks. In order to enable the perpendicular flange 49 on the secondary muntin to be spaced above and rest on the perpendicular flange 47 of the primary muntin as shown in FIG. 8, the primary muntin must extend downwardly beyond the secondary muntin. However, all of the support gaskets for a given glass block must be on the same level. To this end, the gasket 48 positioned on the perpendicular flange 47 of the primary muntin is sufficiently deep such that its total height equals the height of the flange 49 plus gasket 50 of the secondary muntin. The secondary flanged muntin is typically oriented perpendicular to the primary flanged muntin such that when flanges 49 rest on top of flanges 47 and are placed in between sections of gasket 48, the complete perimeter of the glass blocks is supported. The tops of the gaskets 48 and 50 form a continuous square frame and are on the same plane.

Should leakage water enter the system, it will run into a cavity 51 in flanged muntin 46 and then, owing to the overlapping flanges, the water will be directed into a cavity 52 in flanged muntin 45 where it can flow to the perimeter of the system and be exhausted.

The elastomeric spacer and the edge faces of the glass blocks are not shown in FIGS. 6, 7, and 8. A backing pad 54 is shown in FIGS. 6 and 7 covered by sealant 36.

FIG. 8 is an isometric view that illustrates the positioning of the secondary muntins 46 and the intersection with the continuous primary muntins 45 so as to form a gridwork or matrix for a floor or skylight assembly of glass blocks. It also illustrates securing of the secondary muntins 46 with steel rods 7 (passing through them) and the securing of the primary muntins 45 with steel rods 13 (passing through them) or, alternatively, by screws 6 which thread into the hollow bosses at the ends of the primary muntins. In addition, FIG. 8 shows how the flanges 49 of the secondary muntins rest on the flanges 47 of the primary muntins. Holes 57 and notches 56 are made in the primary muntins 45 to accept the steel rods 7 which provide strength and alignment.

Figure 9:
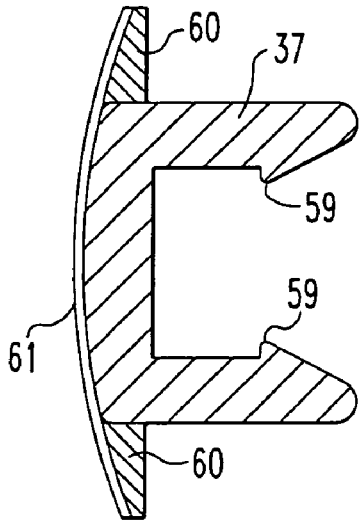
FIG. 9 is a broken away view of a snap-on joint cover.

FIG. 9 is a section through the elastomeric joint cover 37 previously described. It is of an elastomeric material, such as Santoprene, comprising a hard durometer material at its core and a soft durometer material in the area marked 60. The joint cover has two barbed extensions 59 which can be snapped over the beads on the edges of the primary and secondary muntins. The surface of the joint cover is preferably provided with a graffiti-resistant coating 61.

Figure 10:
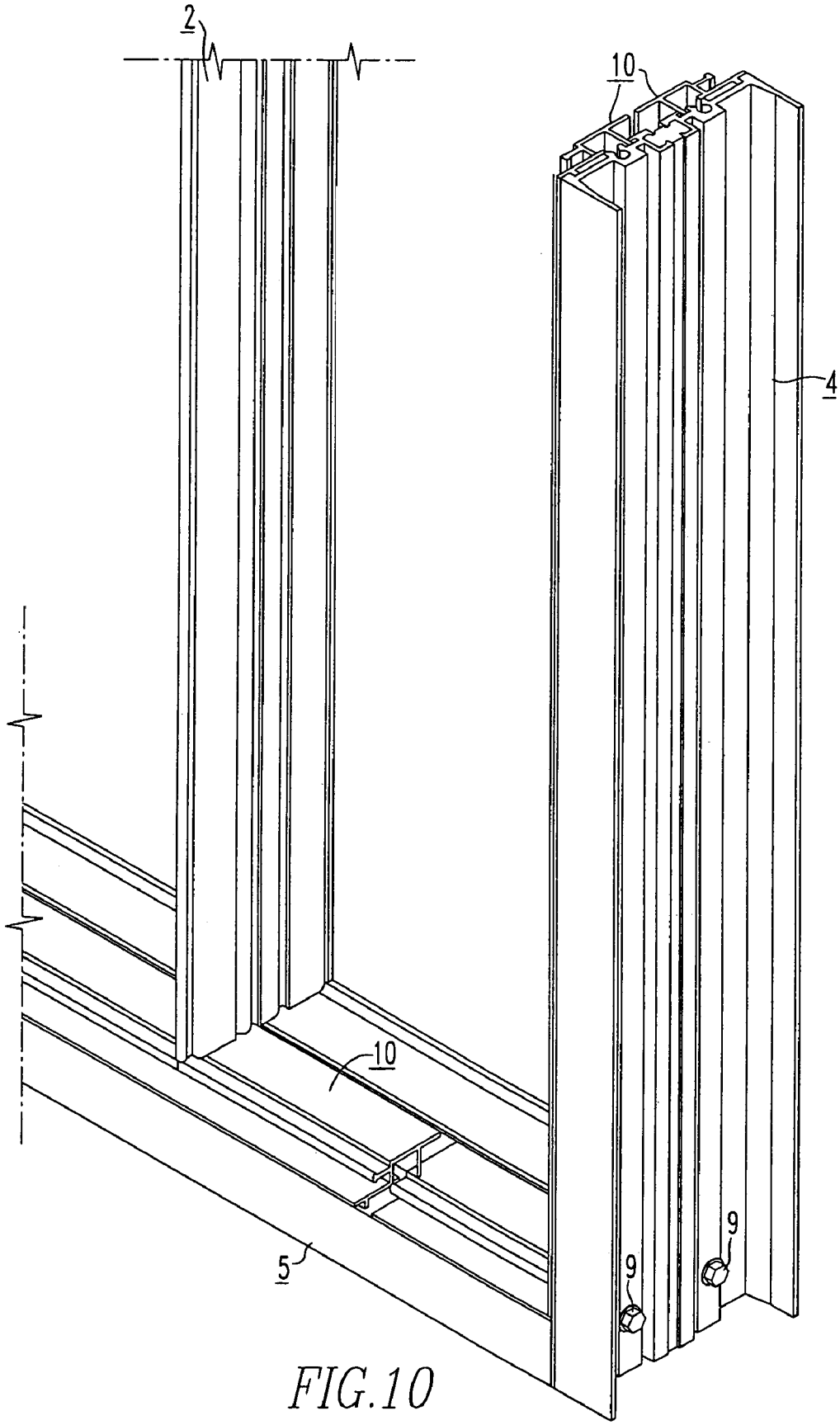
FIG. 10 is an assembled isometric view of a muntin form and structural perimeter frame of a glass block assembly according to this invention.

FIG. 10 shows an alternative embodiment of a glass block assembly having a structural perimeter frame, for example, of aluminum or steel, supporting a muntin array for positioning glass blocks. Preferably the muntins are extruded aluminum. As shown, the array is comprised of primary muntins, no secondary muntins are used. The primary muntins 2 and the structural perimeter frame are constructed similarly to the above described embodiment of FIG. 1 and, therefore, are not further described here. During installation of the glass block assembly, the glass blocks are received in abutting relationship to each other (preferably with plastic spacers separating the adjacent blocks) within the parallel primary muntins 2.

Having thus defined our invention in the detail and particularity required by the Patent Laws, what is desired to be protected by Letters Patents is set forth in the following claims.

The invention claimed is:

1. An assembly of glass blocks held in a structural frame comprising:

a plurality of glass blocks each having two rectangular display faces and four edge faces;

a rectangular structural perimeter frame having four sides;

a plurality of primary muntins, each primary muntin comprising an elongate web with stand-offs lying within parallel planes and extending outward from the web and at least one elongate hollow boss integral with the web positioned within the planes, the primary muntins extending entirely across the structural perimeter frame;

a plurality of secondary muntins, the secondary muntins comprising a web with stand-offs lying within parallel planes and extending outward from the web and at least one hollow boss integral with the web positioned within the planes, lengths of the secondary muntins extending just somewhat longer than lengths of the edge faces or the display faces of the glass blocks;

a plurality of structural rods inserted through the hollow bosses of the secondary muntins and extending entirely across the structural perimeter frame, such that the primary and secondary muntins form a matrix within the structural perimeter frame with openings for receiving the plurality of glass blocks, and;

an elastomeric spacer adapted to be placed at the edge faces of each of the glass blocks or placed on the primary and secondary muntins, wherein the elastomeric spacers contact the edge faces and the stand-offs of the primary and secondary muntins when the glass blocks are inserted in the matrix, and wherein the elastomeric spacers act as a backing to support a sealant for sealing the glass blocks in the matrix.

2. The assembly according to claim 1, wherein the primary muntins and the secondary muntins are extruded.

3. The assembly according to claim 1, wherein the widths of the primary and secondary muntins are substantially the same.

4. The assembly according to claim 1, wherein the widths of the primary and secondary muntins are different.

5. The assembly according to claim 1, wherein the matrix is secured to the structural perimeter frame by nuts on threaded ends of the rods inserted through the hollow bosses of the secondary muntins or by screw fasteners engaging the hollow bosses of the primary muntins.

6. The assembly of claim 5, wherein a plurality of structural rods is inserted through the hollow bosses of the primary muntins and extends across the structural perimeter frame.

7. The assembly of claim 1, wherein sections of the primary and secondary muntins are different in that the hollow bosses in the primary muntins are not located at the same position across the width of the muntin as the hollow bosses in the secondary muntins.

8. The assembly according to claim 1 wherein the spacers are made of an intumescent material.

9. The assembly according to claim 1, wherein the glass blocks are sealed in the matrix with caulking material between the edge faces thereof.

10. The assembly according to claim 9, wherein the glass blocks have central recesses on the edge faces and wherein the caulking enters the recesses.

11. The assembly according to claim 1, wherein the primary and secondary muntin webs have at least one edge along the width thereof having a bead thereon and the assembly further comprises a plurality of elastomeric joint covers that snap over the beads.

12. The assembly according to claim 11, wherein the elastomeric joint cover has a graffiti-resistant coating.

13. The assembly according to claim 1, wherein the muntin webs have exposed beads along an edge of the muntin webs.

14. The assembly according to claim 13, wherein the beads are concealed by joint sealant.

15. The assembly according to claim 1, wherein the width of the primary and secondary muntins is less than the width of the edge faces of the glass blocks.

16. The assembly according to claim 1, wherein the width of the primary and secondary muntins is equal to or greater than the width of the edge faces of the glass blocks.

17. An assembly of glass blocks and vision glass comprising: a plurality of glass blocks having two rectangular display faces and four edge faces;

a vision glass;

a rectangular structural frame having four sides;

a plurality of extruded primary muntins, each primary muntin comprising an elongate web with stand-offs extending outward from the faces of the web and at least one elongate hollow boss integral with the web, the primary muntins extending entirely across the structural frame;

a plurality of extruded secondary muntins, the secondary muntins comprising a web with stand-offs extending from the faces of the web and at least one hollow boss integral with the web, lengths of the secondary muntins extending just somewhat longer than lengths of the edge faces or the display faces of the glass blocks; and a plurality of structural rods inserted through the hollow bosses of the secondary muntins and extending entirely across the structural frame, such that the primary and secondary muntins form a matrix within the frame with openings for receiving the plurality of glass blocks, wherein one side of the structural frame comprises a flexible structure including two facing channels that have restricted relative motion therebetween, one facing channel supporting structural rods and muntins perpendicular thereto and the other facing channel supporting the vision glass.

18. An assembly of glass blocks held in a structural frame comprising:

a plurality of glass blocks each having two rectangular display faces and four edge faces;

a rectangular structural perimeter frame having four sides and further comprising two channels, one channel with extending substantially parallel webs sliding within extending parallel webs of the other channel and with gaskets therebetween permitting slight relative movement;

a plurality of primary muntins, each primary muntin comprising an elongate web with stand-offs extending outward from the web and at least one elongate hollow boss integral with the web, the primary muntins extending entirely across the structural perimeter frame;

a plurality of secondary muntins, the secondary muntins comprising a web with stand-offs extending outward from the web and at least one hollow boss integral with the web, lengths of the secondary muntins extending just somewhat longer than lengths of the edge faces or the display faces of the glass blocks; and a plurality of structural rods inserted through the hollow bosses of the secondary muntins and extending entirely across the structural perimeter frame, such that the primary and secondary muntins form a matrix within the structural perimeter frame with openings for receiving the plurality of glass blocks.

19. The assembly of claim 18, wherein at least one of said channels has a center web with a non-metallic thermal break.

20. The assembly of claim 18, further comprising an edge spacer placed within the structural perimeter frame adjacent to the glass block at the perimeter of the glass block assembly, captured against one of the channels.

21. The assembly of claim 20, wherein the edge spacer comprises a web having two spaced halves, flat portions, and flanges extending from the sides with a beaded edge, said edge spacer positioned with the flat portions adapted to abut an elastomeric spacer on the perimeter face of the glass block.

* * * * *